United States Patent [19]

Garavuso

[11] Patent Number: 4,500,086

[45] Date of Patent: Feb. 19, 1985

[54] ROTATING INVERTER

[75] Inventor: Gerald M. Garavuso, Macedon, N.Y.

[73] Assignee: Xerox Corporation, Stamford, Conn.

[21] Appl. No.: 445,878

[22] Filed: Dec. 1, 1982

[51] Int. Cl.[3] ..... B65H 5/00

[52] U.S. Cl. ..... 271/225; 198/457; 271/184; 271/902

[58] Field of Search ..... 271/3, 225, 184, 185, 271/186, DIG. 9, 264; 198/411, 784, 457

[56] References Cited

U.S. PATENT DOCUMENTS

| | | | |
|---|---|---|---|
| 3,861,673 | 1/1975 | Ticknor | 271/225 |
| 3,917,256 | 4/1975 | Kubasta | 271/186 |
| 3,942,785 | 3/1976 | Stange | 271/65 |
| 4,186,662 | 2/1980 | Borneman | 271/DIG. 9 |

*Primary Examiner*—Duane A. Reger
*Assistant Examiner*—John A. Carroll
*Attorney, Agent, or Firm*—William A. Henry, II

[57] ABSTRACT

A rotating inverter mechanism includes a drive shaft and dual primary and secondary rollers mounted within a set of collars such that the drive shaft is adapted to provide rotation to the primary rollers in a clockwise direction while the secondary rollers which are initially in an out of sheet contact position are driven by the primary rollers in a counterclockwise direction. A sheet passing through the inverter in a clockwise direction actuates a first sensor which in turn actuates a solenoid linked to one of the collars. The solenoid pulls the collar through a predetermined angle and thereby places the corresponding secondary roller in contact with the sheet. Since the secondary roller is rotating in a direction opposite to the incoming sheet direction and opposite to the other primary roller, the sheet will be rotated. A chute is positioned to deflect the sheet downward as it is rotated so that the rotation can be accomplished in a distance no wider than the width of the sheet. The sheet will continue rotation until it actuates a second sensor which in turn actuates another solenoid linked to the other collar and thereby places the other secondary roller in contact with the sheet. The sheet is then driven out of the inverter in a second direction. After the sheet has left the influence of the primary and secondary rollers, it passes a third sensor which sends a signal that deactuates the solenoids and thereby allows the primary rollers to assume their original sheet contact position for feeding a sheet in the clockwise direction.

8 Claims, 11 Drawing Figures

ROTATING INVERTER

The present invention relates to an improved sheet inverting system, and more particularly to a compact inverter that accomplishes improved handling of variable sized sheets within minimal space requirements.

Although a sheet inverter is referred to in the copier art as an "inverter", its function is not necessary to immediately turn the sheet over (i.e., exchange one face for the other). Its function is to effectively reverse the sheet orientation in its direction of motion. That is, to reverse the lead edge and trail edge orientation of the sheet. Typically in inverter devices, the sheet is driven or fed by feed rollers or other suitable sheet driving mechanisms into a sheet reversing chute. By then reversing the motion of the sheet within the chute and feeding it back out from the chute, the desired reversal of the leading and trailing edges of the sheet in the sheet path is accomplished. Depending on the location and orientation of the inverter in a particular sheet path, this may, or may not, also accomplish the inversion (turning over) of the sheet. In some applications, for example, where the "inverter" is located at the corner at a 90° to 180° inherent bend in the copy sheet path, the inverter may be used to actually prevent inverting of a sheet at that point, i.e., to maintain the same side of the sheet face-up before and after this end in the sheet path. On the other hand, if the entering and departing path of the sheet, to and from the inverter, is in substantially the same plane, the sheet will be inverted by the inverter. Thus, inverters have numerous applications in the handling of either original documents or copy sheets to either maintain, or change, the sheet orientation.

Inverters are particularly useful in various systems of pre or post collation copying, for inverting the original documents, or for maintaining proper collation of the sheets. The facial orientation of the copy sheet determines whether it may be stacked in forward or reversed serial order to maintain collation. Generally, the inverter is associated with a by-pass sheet path and gate so that a sheet may selectively by-pass the inverter, to provide a choice of inversion or non-inversion. However, it is particularly difficult to use inverters of this type in small copiers that take advantage of short edge paper transport to reduce costs by reducing overall machine depth.

Short edge feeding creates a problem in sheet inversion when the duplex function is added to the machine. Some standard inverter techniques result in the top of the duplex image occurring at the bottom of the simplex image.

The rotating inverter of the present invention alleviates the above-mentioned problem by providing a simple, low cost inverter apparatus that pivots between input and output positions and an intermediate sheet turnaround position while inverting copies.

A preferred feature of the present invention is to provide sheet rotation and inversion without including excess machine depth and at a minimal unit manufacturing cost.

Further features and advantages of the invention pertain to the particular apparatus whereby the above-noted aspects of the invention are obtained. Accordingly, the invention will be better understood by reference to the following description, and to the drawings forming a part thereof, which are approximately to scale, wherein.

Figure 1:
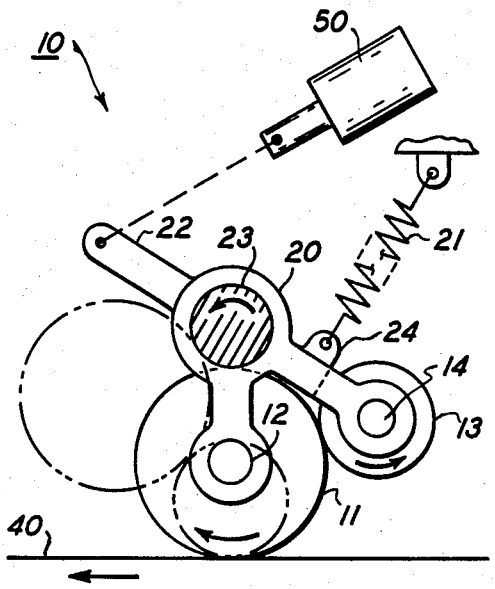
FIG. 1 is a partial elevational view of an inverter mechanism according to the present invention.
Figure 2:
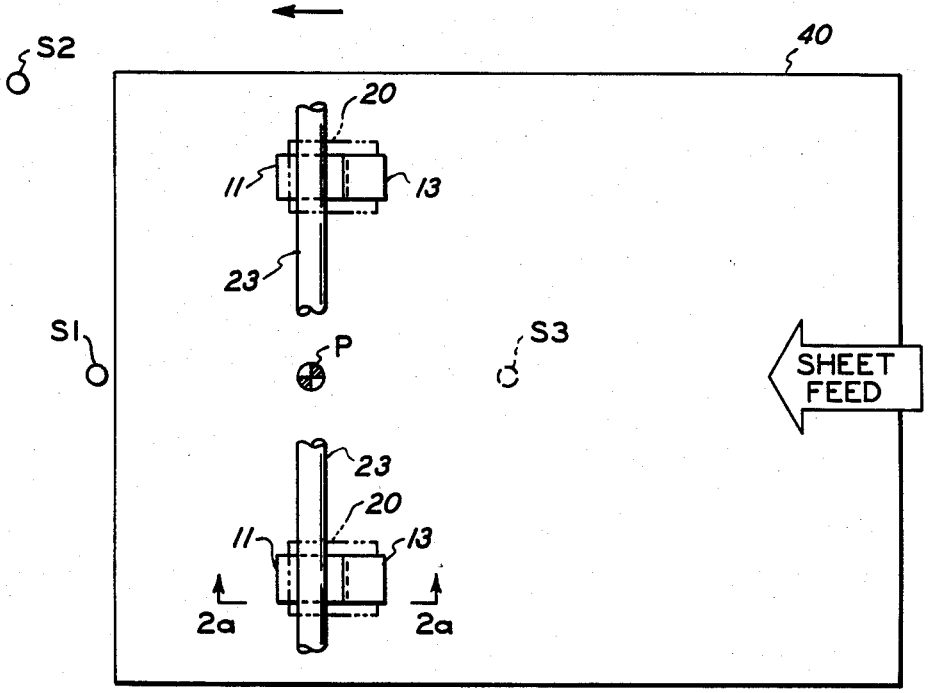
FIG. 2 is a diagrammatic plan view showing a sheet being driven in the sheet feed direction by the inverter of the present invention.
Figure 2A:
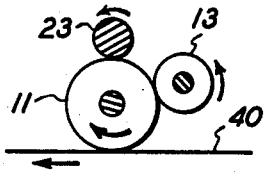

FIG. 2*a* is a partial elevational view of the inverter shown in FIG. 1 showing primary drive rollers in contact with a sheet.

Figure 3:
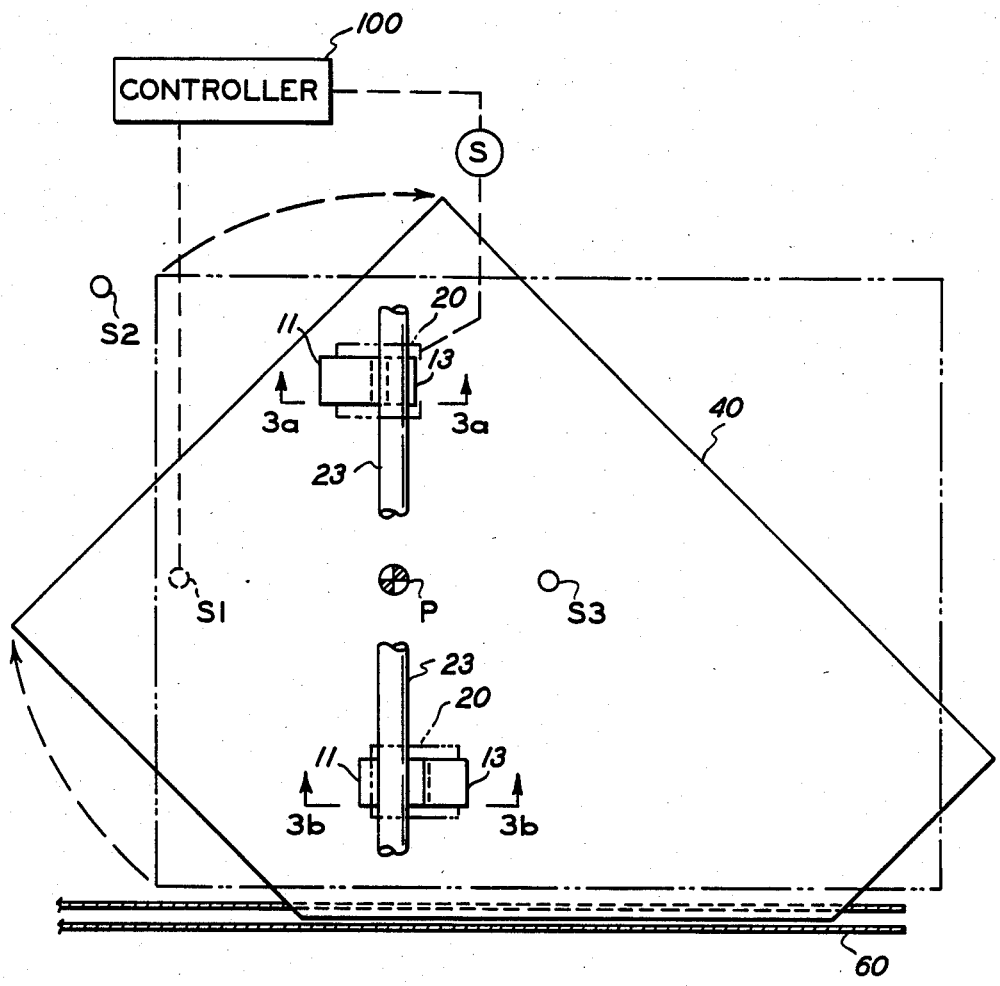

FIG. 3 is a diagrammatic plan view showing the sheet in FIG. 1 after having been rotated 45° by the present inverter and bent downward into a chute.

Figure 3B:
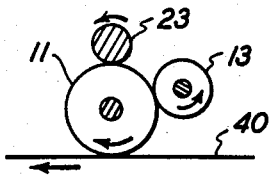
Figure 3A:
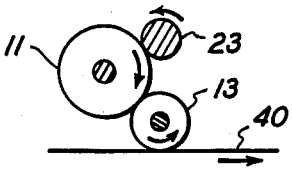

FIGS. 3*a* and 3*b* show the position of primary and secondary rollers that accomplishes the 45° rotation of the sheet in FIG. 3.

Figure 4:
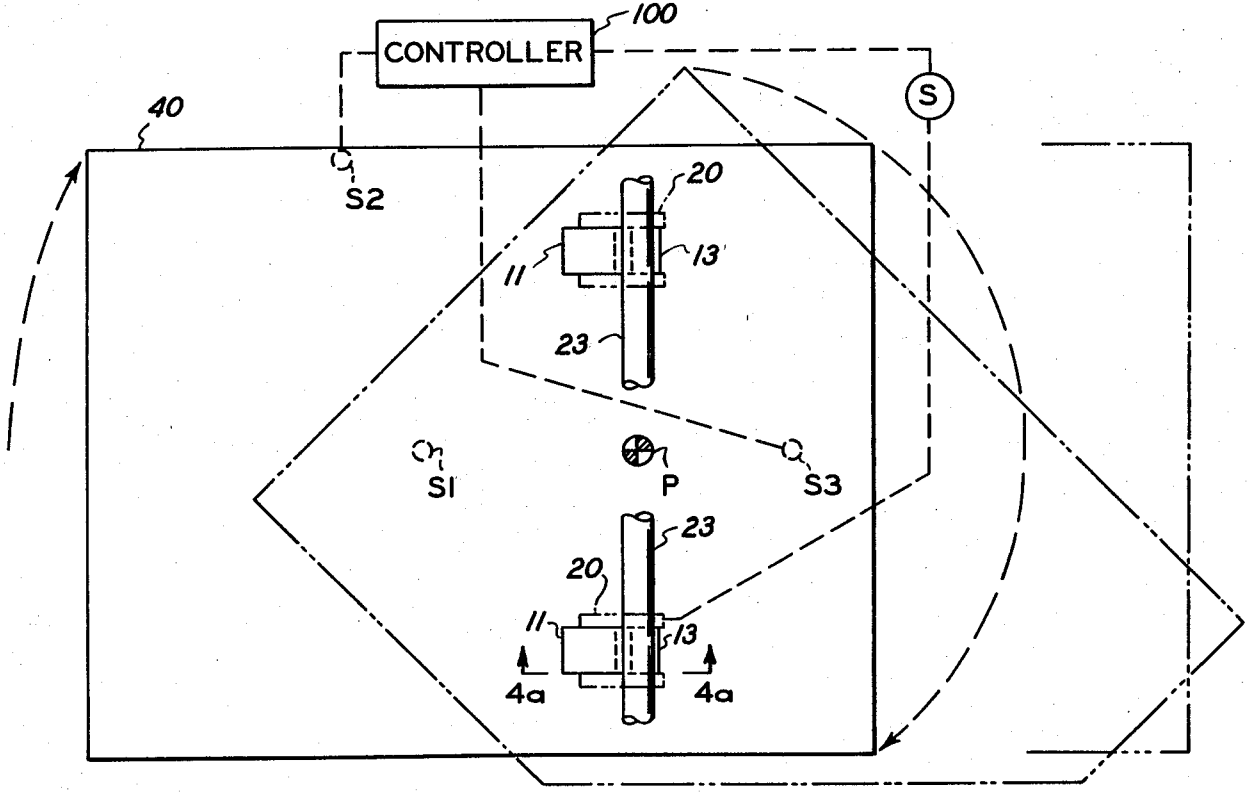

FIG. 4 is a diagrammatic plan view showing the sheet of FIG. 1 rotated 180° by the present inverter.

Figure 4A:
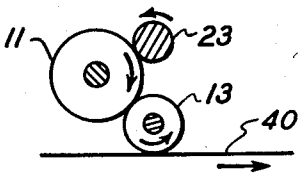

FIG. 4*a* is a partial elevational view of the inverter in FIG. 4 showing secondary rollers in position to drive the sheet in a direction opposite to the incoming sheet direction.

Figure 5:
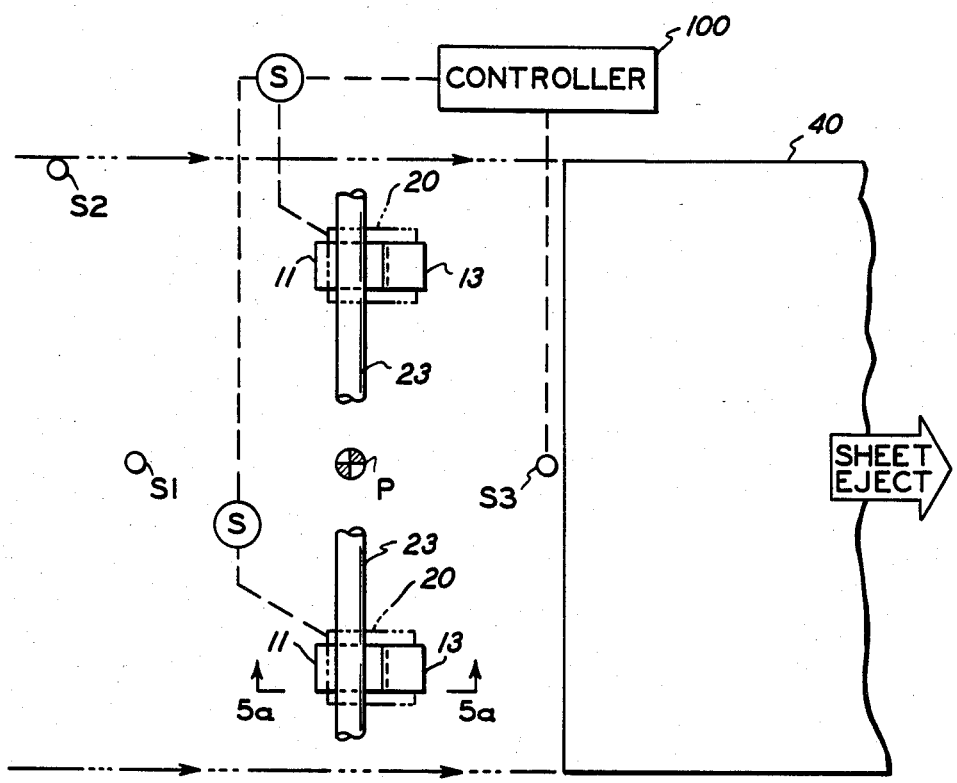

FIG. 5 is a diagrammatic plan view showing the sheet in FIG. 4 driven past sensor S3.

Figure 5A:
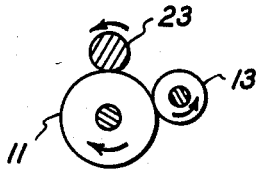

FIG. 5*a* is a partial elevational view of the inverter of FIG. 5 showing the position of the primary and secondary rollers after the sheet has past sensor S3.

Figure 6:
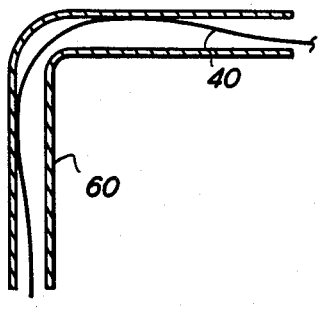

FIG. 6 is a partial end view of the chute shown in FIG. 3.

While the present invention will be described in a preferred embodiment, it will be understood that it is not intended to limit the invention to that embodiment. On the contrary, it is intended to cover all alternatives, modifications and equivalents as may be included within the spirit and scope of the invention as defined by the appended claims.

The apparatus that encompasses the present invention will now be described in detail with reference to the Figures where like reference numerals will be employed throughout to designate identical elements. Although the apparatus for inverting sheets is particularly well adapted for use in the paper path of a printing machine, it should be evident from the following discussion that it is equally well suited for use in a wide variety of devices and is not necessarily limited in its application to the particular embodiment shown. For example, the apparatus of the present invention will be described hereinafter with reference to inverting copy sheets, however, one skilled in the art, will appreciate that it may also be employed for inverting original documents.

Referring now to FIG. 1, rotating inverter apparatus 10 comprises representative primary roller 11 rotatably mounted on a shaft 12 and secondary roller 13 rotatably mounted on shaft 14. Shafts 12 and 14 are supported by a collar 20 which in turn is supported by a drive shaft 23 that drives primary roller 11 as a result of being by a conventional motor not shown. Collar 20 is adapted to position secondary roller 13 directly against primary roller 11, therefore, as primary roller 11 is driven in a clockwise direction by drive shaft 23 secondary roller 13 will be driven by the primary roller in a counterclockwise direction. Since secondary roller 13 is driven through friction by primary roller 11 the surface velocity is constant in magnitude for both rollers with only the direction of rotation changing. Primary roller 11 is spring loaded against sheet 40 by the use of spring 21 that is attached at 24 to one side of collar 20 between shafts 23 and 14 and a fixed support. A solenoid 50 is linked to an extention arm 22 of the collar and adapted when actuated to retract and thereby rotate or pivot collar 20 about shaft 23 through an arc such that primary roller 11 will be replaced by secondary roller 13 in contact with sheet 40. Deactuation of solenoid 50 and the tension in spring 21 will cause primary roller 11 to replace secondary roller 13 as the drive roller for sheet 40.

In FIG. 2, it is seen that the present inverter mechanism includes dual primary and secondary rollers that are spaced apart and driven by drive shaft 23 which is rotating in a counterclockwise direction. Sheet 40 is driven to the left as viewed in FIG. 2*a* and covers normally off sensor S3. When the lead edge of the sheet moves a distance beyond the rollers that is greater than the distance between the rollers, sensor S1 will be covered and actuated as shown in FIG. 3. A signal from sensor S1 is sent to controller 100 which in turn sends a signal through relay or switch S to solenoid 50 of FIG. 1. The solenoid retracts thereby shifting one of the primary rollers 11 to the position shown in FIG. 3*a*, while the other primary roller remains in the position shown in FIG. 3*b*. It should be understood that while the roller on the right as viewed in FIG. 3 is shifted, the opposite roller could be the shifted roller in response to a signal generated by sensor S1 if desired. This shifting will cause sheet 40 to rotate due to the influence of newly positioned secondary roller 13 about pivot point P to the right through an angle of 180°. As the sheet rotates, it is curled downward into channel means or chute 60 which is shown more clearly in FIG. 6. The chute allows rotation of the sheet to take place within a minimum of machine depth. Short edge inversion often requires rotation of a sheet. For a short edge machine this requires that at least one portion of the machine be wide enough to accommodate a circle whose diameter is equal to or greater than the diagonal of the largest sheet handled. Baffle 60 eliminates this requirement and thereby saves space and machine costs. The curved baffle directs the tail edge of the sheet downward along a portion of the machine in which it is used thus keeping the X dimension of the machine at a minimum.

After the sheet has rotated 180° as shown in FIG. 4, it covers sensor S2 which through conventional controller 100 sends an actuation signal to the solenoid linked to the other roller mechanism of inverter 10 and to sensor S3 to turn it ON. Actuation of this solenoid will, through collar 20, remove roller 11 from the sheet surface and place secondary roller 13 in driving relation to the sheet. Now, with both roller assemblies having secondary rollers 13 in contact with the sheet as shown in FIG. 4*a*, it will be driven in a counterclockwise direction. The sheet will continue to be driven in this reversed direction until it uncovers sensor S3 as shown in FIG. 5.

The uncovering of sensor S3 shuts OFF the sensor which results in a signal from controller 100 to deactuate solenoids 50 linked to each roller assembly. Once the solenoids are deactuated, the roller assemblies assume the position shown in FIG. 5*a* with primary rollers 11 now in position to drive another sheet in the input or clockwise direction.

In conclusion, a rotating inverter has been disclosed that accomplishes reversing the lead and tail edges of a sheet in a minimum of space with a simple toggling apparatus that comprises a pair of collars mounted on a drive shaft that drives spaced apart, primary rollers also supported by the collars. Secondary rollers are supported by the collars in such a position that they are driven by friction from the primary rollers. Selective toggling of either one or both of the collars will cause a sheet to be driven in a dirst direction, rotated 180° or forwarded in a second and opposite direction.

I claim:

1. An inverter device for use in a sheet conveying apparatus, comprising:

a drive shaft;

dual pivotable collars supported by said drive shaft;

dual pair of primary and secondary rollers mounted through yoke means to said dual collars such that said primary rollers are driven by said drive shaft while said secondary rollers are simultaneously driven by said primary rollers, said primary and secondary rollers being adapted to convey a sheet in a first or second direction; and means for independently pivoting said dual collars from a first position to a second position so that when both collars are in said first position a sheet is driven by said primary rollers in said first direction and when only one of said collars is pivoted into said second position the sheet is rotated 180° in a horizontal plane due to the driving of a primary and secondary roller and when both collars are pivoted into said second position the sheet is driven in said second direction by the driving of said dual pairs of secondary rollers.

2. The inverter device of claim 1, including means for returning said dual collars to said first position after the sheet has traveled a predetermined distance in said second direction.

3. The inverter device of claim 1, including means for deflecting the sheet from said horizontal plane as it is being rotated.

4. A method for inverting sheets, comprising the steps of:

providing a drive shaft;

providing dual pivotable collars supported by said drive shaft;

dual pairs of primary and secondary rollers mounted through yoke means to said dual collars such that said primary rollers are driven by said drive shaft while said secondary rollers are simultaneously driven by said primary rollers, said primary and secondary rollers being adapted to convey a sheet in a first or second direction; and providing means for independently pivoting said dual collars from a first position to a second position so that when both collars are in said first position a sheet driven by said primary rollers in said first direction and when only one of said collars is pivoted into said second position the sheet is rotated 180° in a horizontal plane due to the driving of a primary and secondary roller and when both collars are pivoted into said second position the sheet is driven in said second direction by the driving of said dual pairs of secondary rollers.

5. The method of claim 4, including the step of returning said dual collars to said first position after the sheet has traveled a predetermined distance in said second direction.

6. A sheet inverting method, comprising the steps of:

feeding a sheet in a first direction;

sensing when the sheet reaches a predetermined location and providing a signal;

utilizing said signal to actuate a means for rotating the sheet 180° in a horizontal plane;

bending the sheet downward for a portion of its travel as it is being rotated;

providing a signal indicative of the sheet having been rotated 180°; and feeding the sheet in a second direction in response to said signal indicating that the sheet has completed 180° rotation.

7. A sheet inverting method, comprising the steps of:

feeding a sheet in a first direction;

sensing when the sheet reaches a predetermined location and providing a signal;

utilizing said signal to actuate a means for rotating the sheet 180° in a horizontal plane;

providing a signal indicative of the sheet having been rotated 180°; and feeding the sheet in a second direction in response to said signal indicating that the sheet has completed 180° rotation.

8. The method of claim 7, including the steps of providing a pivot point for rotation of the sheet and maintaining said pivot point the same throughout rotation of the sheet.

* * * * *